US008380438B2

(12) United States Patent
Jarrot et al.

(10) Patent No.: US 8,380,438 B2
(45) Date of Patent: Feb. 19, 2013

(54) WIDEBAND MUD PUMP NOISE CANCELATION METHOD FOR WELLBORE TELEMETRY

(75) Inventors: Arnaud Jarrot, Chatillon (FR); Benjamin Jeffryes, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 670 days.

(21) Appl. No.: 12/485,754

(22) Filed: Jun. 16, 2009

(65) Prior Publication Data

US 2010/0314169 A1 Dec. 16, 2010

(51) Int. Cl.
*G01V 1/40* (2006.01)

(52) U.S. Cl. ..... 702/9

(58) Field of Classification Search ..... 702/6–13
See application file for complete search history.

(56) References Cited

U.S. PATENT DOCUMENTS 4,642,800 A 2/1987 Umeda et al.
5,396,232 A 3/1995 Mathieu et al.
5,642,051 A 6/1997 Babour et al.
6,741,185 B2 5/2004 Shi et al.
2006/0214814 A1 9/2006 Pringnitz et al.
2007/0192031 A1* 8/2007 Li et al. ..... 702/6
2008/0068211 A1 3/2008 Aiello et al.

OTHER PUBLICATIONS

Branko Ristic, Sanjeev Arulampalam, Neil Gordon Beyond the Kalman Filter: Particle Filters for Tracking Applications, Artech House Publishers, 2004, pp. 35-62.
Simon Haykin, Adaptive Filter Theory 3rd Edition, Prentice Hall Information and System Sciences Series, 1995 pp. 302-334.
T.S. Rappaport, wireless communciations principle and practice, Prentice Hall, 1996 pp. 312-335.

* cited by examiner

*Primary Examiner* — Stephen Cherry
(74) *Attorney, Agent, or Firm* — Chadwick Sullivan

(57) ABSTRACT

A method for attenuating pump noise in a wellbore drilling telemetry system includes spectrally analyzing measurements of a parameter related to operation of a pump used to move drilling fluid through the drilling system. Synthetic spectra of the parameter are generated based on a number of pumps in the pump system and a selected number of harmonic frequencies for each pump. Which of the synthetic spectra most closely matches the spectrally analyzed parameter output is determined. The most closely matching synthetic spectrum is used to reduce noise in a signal detected proximate the Earth's surface transmitted from a part of the drilling system disposed in a wellbore.

20 Claims, 4 Drawing Sheets

WIDEBAND MUD PUMP NOISE CANCELATION METHOD FOR WELLBORE TELEMETRY

BACKGROUND OF THE INVENTION

1. Field of the Invention

The invention relates generally to the field of measurement while drilling systems. More specifically, the invention relates to methods for reducing the effects of noise caused by "mud" pumps on the signal channel for measurement while drilling systems that use mud flow modulation telemetry or an electromagnetic telemetry.

2. Background Art

Measurement while drilling ("MWD") systems and methods generally include sensors disposed in or on components that are configured to be coupled into a "drill string." A drill string is a pipe or conduit that is used to rotate a drill bit for drilling through subsurface rock formations to create a wellbore therethrough. A typical drill string is assembled by threadedly coupling end to end a plurality of individual segments ("joints") of drill pipe. The drill string is suspended at the Earth's surface by a hoisting unit known as a "drilling rig." The rig typically includes equipment that can rotate the drill string, or the drill string may include therein a motor that is operated by the flow of drilling fluid ("drilling mud") through an interior passage in the drill string. During drilling a wellbore, some of the axial load of the drill string to the drill bit located at the bottom of the drill string. The equipment to rotate the drill string is operated and the combined action of axial force and rotation causes the drill bit to drill through the subsurface rock formations.

The drilling fluid (hereinafter "mud") is pumped through the interior of the drill string by various types of pumps disposed on or proximate the drilling rig. The mud exits the drill string through nozzles or courses on the bit, and performs several functions in the process. One is to cool and lubricate the drill bit. Another is to provide hydrostatic pressure to prevent fluid disposed in the pore spaces of porous rock formations from entering the wellbore, and to maintain the mechanical integrity of the wellbore. The mud also lifts the drill cuttings created by the bit to the surface for treatment and disposal.

In addition to the above mentioned sensors, the typical MWD system includes a data processor for converting signals from the sensors into a telemetry format for transmission of selected ones of the signals to the surface. In the present context, it is known in the art to distinguish the types of sensors used in a drill string between those used to make measurements related to the geodetic trajectory of the wellbore and certain drilling mechanical parameters as "measurement while drilling" sensors, while other sensors, used to make measurements of one or more petrophysical parameters of the rock formations surrounding the wellbore are frequently referred to as "logging while drilling" ("LWD") sensors. For purposes of the description of the present invention, the term MWD or "measurement while drilling" is intended to include both of the foregoing general classifications of sensors and systems including the foregoing, and it is expressly within the scope of the present invention to communicate any measurement whatsoever from a component in drill string to the surface using the method to be described and claimed herein below.

Communicating measurements made by one or more sensors in the MWD system is typically performed by the above mentioned data processor converting selected signals into a telemetry format that is applied to a valve or valve assembly disposed within a drill string component such that operation of the valve modulates the flow of drilling mud through the drill string. Modulation of the flow of drilling mud creates pressure variations in the drilling mud that are detectable at the Earth's surface using a pressure sensor (transducer) arranged to measure pressure of the drilling mud as it is pumped into the drill string. Forms of mud flow modulation known in the art include "negative pulse" in which operation of the valve momentarily bypasses mud flow from the interior of the drill string to the annular space between the wellbore and the drill string; "positive pulse" in which operation of the valve momentarily reduces the cross-sectional area of the valve so as to increase the mud pressure, and "mud siren", in which a rotary valve creates standing pressure waves in the drilling mud that may be converted to digital bits by appropriate phasing of the standing waves.

Irrespective of the type of mud flow modulation telemetry used, detection of the telemetry signal at the Earth's surface may be difficult because of two principal reasons. First, while drilling mud as a liquid is relatively incompressible, it does have non-zero compressibility. Consequently, as the pressure variation travels from the valve to the surface, some of the energy therein is dissipated by compression and rarefaction of the mud as the wave traverses the drill string. Second, and more importantly, the pumps used to move the drilling mud through the drill string are very large and powerful, and frequently are of the positive displacement type. As a result, the mud pumps themselves generate large pressure variations in the mud as it is pumped through the drill string, thus masking the pressure variation signal being transmitted by the MWD instrument.

U.S. Pat. No. 6,741,185 issued to Pengyu et al. describes a method exploiting the raw pressure to estimate the parameters of the noise. The estimation is carried out in two separated tasks: the estimation of the instantaneous frequency on one side, and the estimation of other parameters on the other side via an adaptive filtering approach. U.S. Patent Application Publication No. 200710192031 submitted by Jiang Li et al. describes a similar approach using a LMS algorithm to estimate the parameters of the noise. Because both estimators are completely separated, the ability of the foregoing methods to cancel mud pump noise over a broad frequency band is limited. U.S. Pat. No. 4,642,800 issued to Umeda et al. describes a mud pump noise canceling method based on the use of a set of "stroke counters" (devices which count the operating cycles of each cylinder of the pump) to estimate the instantaneous frequency of the mud pumps. However, the estimation of the instantaneous frequency is assumed to vary linearly with the stroke counter output which is not necessarily a valid assumption.

Selected telemetry signals are alternatively provided to an antenna disposed in the drill string that broadcasts low frequency (generally up to about 25 Hz) signals through the formation where they may be detected by a surface antenna such as spaced apart electrodes (hereinafter referred to as "stakes") disposed in the ground. Examples of electromagnetic telemetry systems are disclosed in U.S. Pat. Nos. 5,642,051, 5,396,232, and U.S. application Ser. No. 11/308,026, each of which are assigned to the present assignee.

The electromagnetic telemetry signal may likewise be masked by signal noise arising from mud pump operation. The mud pumps may create either cyclical electrical interference that mimics the repetitive activity of the mud pumps, or asynchronous noise arising from, for example, electrical interference generated by power drains caused by any sort of mechanical problem.

What is needed is more reliable methods for estimating and reducing mud pump noise for use with mud pulse telemetry and electromagnetic telemetry MWD systems.

SUMMARY OF THE INVENTION

A method according to one aspect of the invention for attenuating pump noise in a wellbore drilling system includes spectrally analyzing measurements of a parameter related to operation of a pump used to move drilling fluid through the drilling system. Synthetic spectra of the parameter are generated based on a number of pumps in the pump system and a selected number of harmonic frequencies for each pump. Which of the synthetic spectra most closely matches the spectrally analyzed parameter output is determined. The most closely matching synthetic spectrum is used to reduce noise in a signal detected proximate the Earth's surface transmitted from a part of the drilling system disposed in a wellbore.

Other aspects and advantages of the invention will be apparent from the following description and the appended claims.

DETAILED DESCRIPTION

Figure 1:
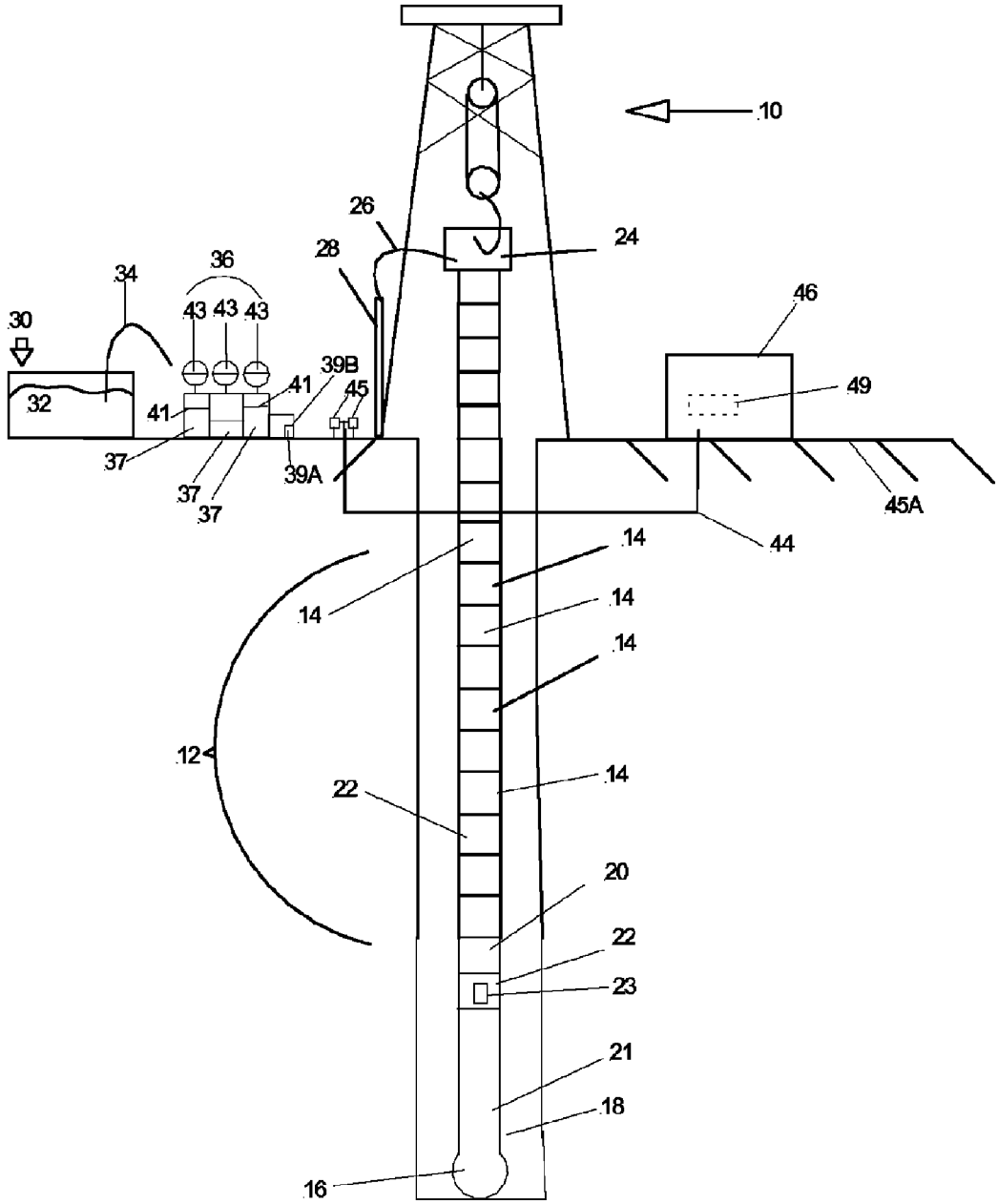
FIG. 1 shows an example drilling system that may use a pump noise reduction method according to the invention.
Figure 1A:
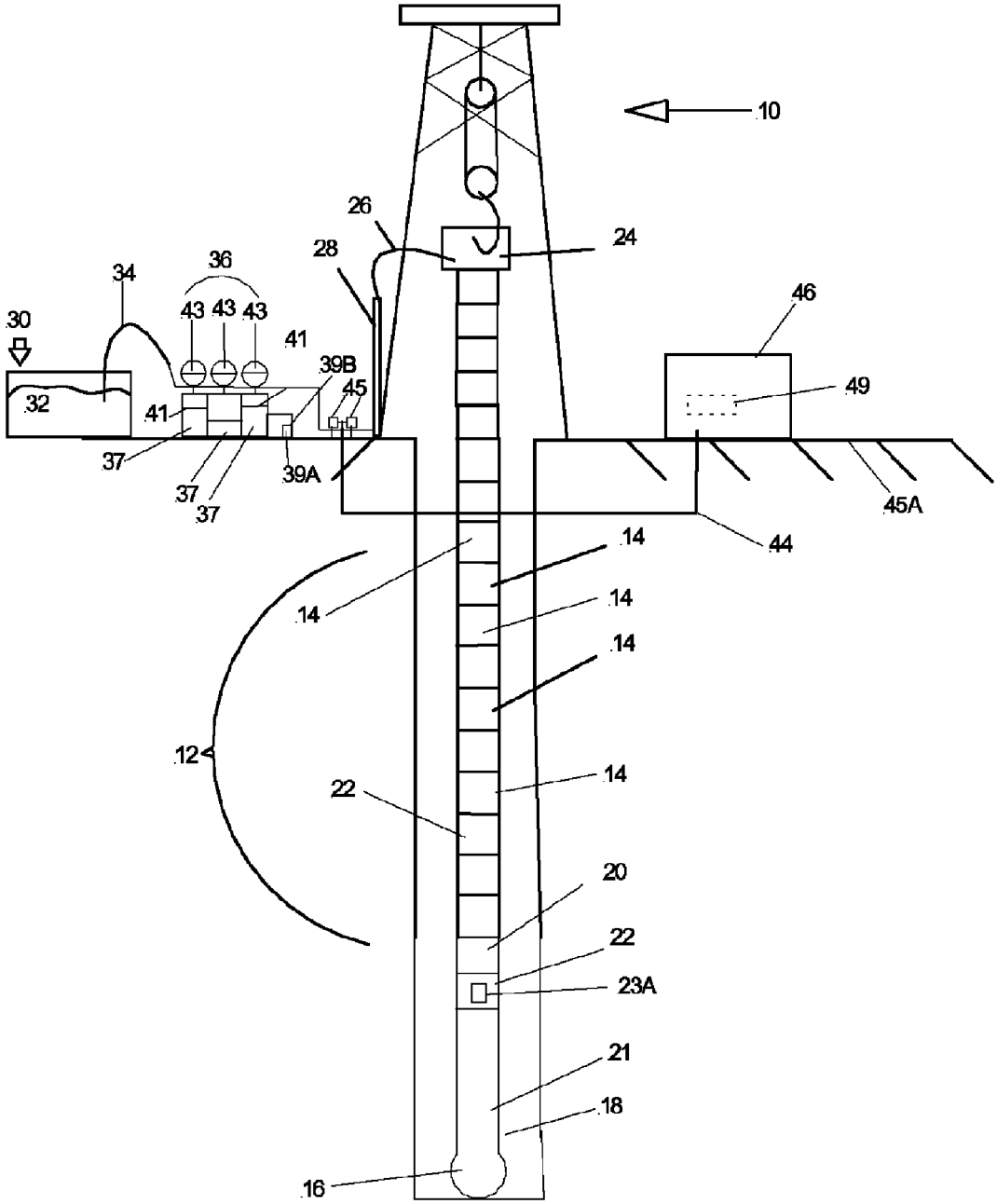
FIG. 1A shows an alternative example drilling system to that illustrated in FIG. 1.

A typical wellbore drilling system, including measurement while drilling ("MWD") devices that can be used in according with various examples of the invention is shown schematically in FIG. 1. A hoisting unit called a "drilling rig" suspends a conduit of pipe called a drill string 12 in a wellbore 18 being drilled through subsurface rock formations, shown generally at 11. The drill string 12 is shown as being assembled by threaded coupling end to end of segments or "joints" 14 of drill pipe, but it is within the scope of the present invention to use continuous pipe such as "coiled tubing" to operate a drilling system in accordance with the present invention. The rig 10 may include a device called a "top drive" 24 that can rotate the drill string 12, while the elevation of the top drive 24 may be controlled by various winches, lines and sheaves (not identified separately) on the rig 10. A drill bit 16 is typically disposed at the bottom end of the drill string 12 to drill through the formations 11, thus extending the wellbore 18.

As explained in the Background section herein, drilling fluid ("drilling mud") is pumped through the drill string 12 to perform various functions as explained above. In the present example, a tank or pit 30 may store a volume of drilling mud 32. The intake 34 of a mud pump system 36 is disposed in the tank 30 so as to withdraw mud 32 therefrom for discharge by the pump system 36 into a standpipe, coupled to a hose 26, and to certain internal components in the top drive 26 for eventual movement through the interior of the drill string 12.

The example pump system 36 shown in FIG. 1 is typical and is referred to as a "triplex" pump. The system 36 includes three cylinders 37 each of which includes therein a piston 41. Movement of the pistons 41 within the respective cylinders 37 may be effected by a motor 39 such as an electric motor. A cylinder head 40 may be coupled to the top of the cylinders 37 and may include reed valves (not shown separately) or the like to permit entry of mud into each cylinder from the intake 34 as the piston 37 moves downward, and discharge of the mud toward the standpipe as the piston 37 moves upward. Because the piston velocity is variable even at constant motor speed, the pressure in the standpipe 28 varies as the velocity of the pistons 37 changes. Typical triples pumps such as the one shown in FIG. 1 may include one or more pressure dampeners 43 coupled to the output of the pump system 36 or to the output of each cylinder to reduce the variation in pressure resulting from piston motion as explained above. In some examples, a device to count the number of movements of each piston through the respective cylinder may be coupled in some fashion to the motor or its drive output in order that the system operator can estimate the volume displaced by the pump system 36. One example is shown at 39A and is called a "stroke counter." Such devices called stroke counters are well known in the art. It should also be noted that the invention is not limited to use with "triplex" pumps. Any number of pump elements may be used in a pump system consistently with the scope of the present invention.

As the drilling mud reaches the bottom of the drill string, it passes through various MWD instruments shown therein such as at 20, 22 and 21. One of the MWD instruments, e.g., the one at 22, may include a mud flow modulator 23 that is coupled to a controller in one of the MWD instruments to modulate the flow of drilling mud to represent signals from one or more of the MWD instruments 20, 22, 21. It should be reemphasized that "MWD" as used in the present context is intended to include "LWD" instrumentation as explained in the Background section herein. Pressure variations representative of the signals to be transmitted to the surface may be detected by one or more pressure transducers 45 coupled into the standpipe side of the drilling mud circulation system. Signals generated by the transducer(s) are communicated, such as over a signal line 44 to a recording unit 46 having therein a general purpose programmable computer 49 (or an application specific computer) to decode and interpret the pressure signals from the transducer(s) 45.

In some examples, electromagnetic telemetry may be used to communicate signals from the MWD instruments 20, 21, 22 to the surface. In such examples, the mud flow modulator may be replaced by an antenna 23A disposed in the drill string and in electrical communication with a telemetry transmitter (not shown separately) in the MWD instrumentation. Low frequency (generally up to about 25 Hz) signals are transmitted through the formations 11 where they may be detected by a surface antenna such as spaced apart electrodes 45A disposed in the ground and in communication with the computer 49 in the recording system 38. In such examples, the pump system 36 may include one or more sensors such as a current meter, Hall effect transducer, or similar device, e.g., at 39B to detect noise generated by the pump system 36.

Figure 2:
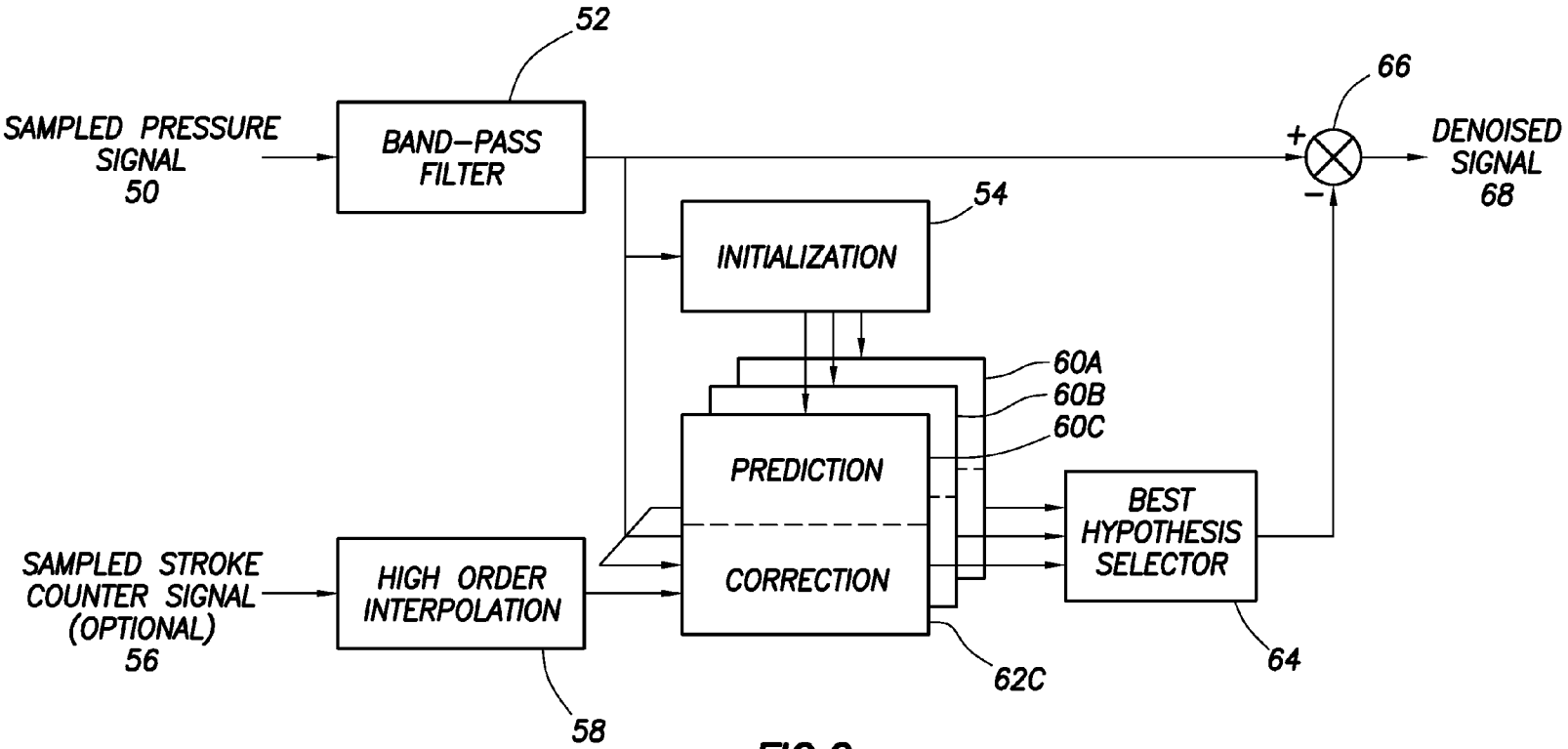
FIG. 2 is a flow chart of an example pump noise reduction process according to the invention.
Figure 3:
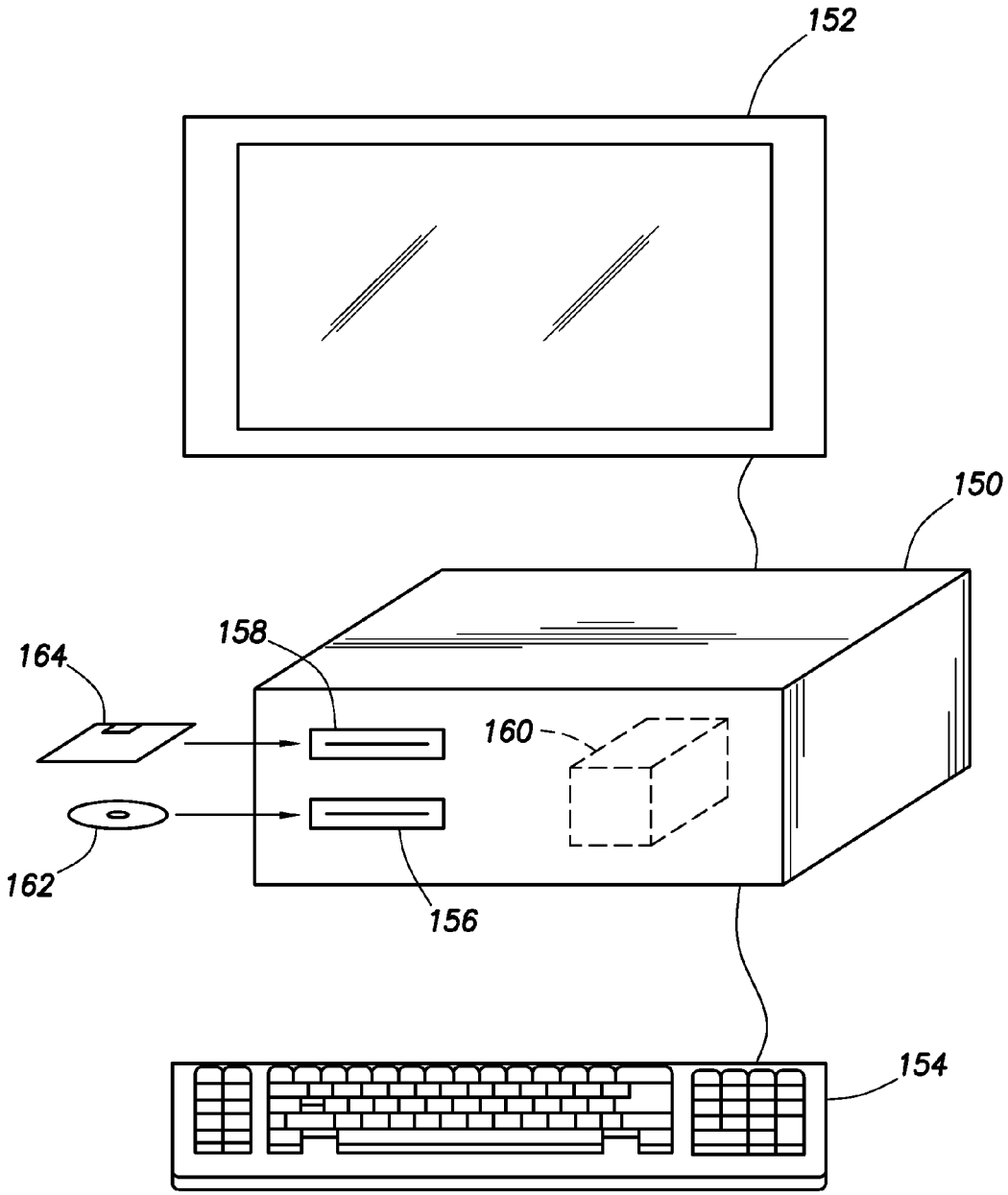
FIG. 3 shows examples of a programmable computer and computer readable media.

Having explained the drilling, mud pump system and mud flow modulation telemetry system in general terms, an example mud pump noise reduction technique according to the invention will now be explained with reference to FIG. 2. The following process elements may be performed in the computer in the recording unit, or may be performed in a different computer. At 50, signals from the transducer(s) (45 in FIG. 1), and in electromagnetic telemetry examples from the sensor 39B, may be conducted to a bandpass filter, at 52 to exclude portions of the transducer/sensor signal that are unlikely to be representative of signals transmitted from the MWD instruments. The bandpass filtered signals may be conducted to one input of a summing device 66, which will be further explained below. The filtered pressure/sensor signals may also be conducted to a prediction initializer at 54. As will be further explained, a set of parameters may be initialized at the start of a pump noise signal prediction process. At 56, signals from the stroke counter (39A in FIG. 1) may be used in some examples as part of the parameter initialization. At 58, the stroke counter signals, if used, may be interpolated with respect to time to produce an approximation of certain fundamental frequency mud pump system noise signals.

After initialization, using the bandpass filtered pressure/sensor signals, a set of prediction filters is generated, as shown at 60A, 60B, 60C. For each prediction filter generated, a corresponding correction filter is generated, one such being shown at 62C that corresponds to prediction filter 60C. After generation of the correction filters, a best noise hypothesis is selected at 64. The selected best noise hypothesis is conducted to the summing device 66 to be combined with the bandpass filtered pressure signal from the transducer(s) (45 in FIG. 1). A result, at 68 is "denoised" pressure signals, that is, pressure signals with mud pump system induced noise substantially attenuated. To summarize the noise prediction/correction procedure, the following acts are performed (e.g., in the computer in the recording system). Alternatively an inverse electromagnetic noise signal may be generated and added to the signal detected by the antenna (45A in FIG. 1).

First, a selected time span of pressure data from the transducer (45 in FIG. 1) or sensor signal data (39B in FIG. 1) may be spectrally analyzed. One non-limiting example of spectral analysis is to perform a fast Fourier transform on the selected time span of pressure data. Next is to generate a set of synthetic spectra using the number of mud pumps in the pump system (36 in FIG. 1), and a selected number Mk of harmonic frequencies for the pressure signal generated by each of the pumps. The synthetic spectra may be initialized based on estimated fundamental frequencies from the stroke counter (39A in FIG. 1). Next is to adaptively filter all the foregoing synthetic spectra with a Bayesian filter approach (e.g., Kalman filters) with prediction/correction procedure. Next is to determine which synthetic spectrum most closely matches the measured spectrum (i.e., the sample of pressure data within the selected time span). Next is to synthesize a pump pressure signal from the best match synthetic spectrum. Finally, is to subtract the synthesized pump pressure signal from the pressure transducer signal. Part or all of the foregoing procedure may be repeated in the event the difference between the synthesized pump pressure signal and the measured pressure signal is greater than a selected threshold.

An explanation of the initialization, prediction filter generation, correction filter generation and best hypothesis selection follows. The harmonic structure of the noise generated by the pump system (36 in FIG. 1) can be represented by the mathematical expression:

$$p(t) = \sum_{k=1}^{K_m} \sum_{m=1}^{M} a_{m,k}(t) \cdot \sin(k \cdot \theta_m(t) + \theta_{m,k}) \tag{1}$$

in which M: is the number of mud pumps in the mud pump system (e.g., three as shown in the example in FIG. 1 but not limited to three); $K_m$ is a selected number of harmonic frequencies associated with the $m^{th}$ pump. Such number of harmonics will depend on the characteristics of the particular pump. $a_{m,k}(t)$ is the amplitude of the $k^{th}$ harmonic of the $m^{th}$ pump and $\theta_{m,k}$ is the initial phase of the $k^{th}$ harmonic of the $m^{th}$ pump.

From equation (1) different state/observation vector models can be defined, depending on the parameters that are considered. An example solution is to link the instantaneous amplitude and the initial phase to ensure a better control on the variance of the state vector.

Each pump harmonic can be rewritten according to the expression:

$$\begin{aligned}
a_{m,k}(t) \cdot \cos\begin{pmatrix} k \cdot \theta(t) + \\ \theta_{m,k} \end{pmatrix} &= a_{m,k}(t) \cdot \frac{\begin{matrix}\exp(ik \cdot \theta(t) + i\theta_{m,k}) - \\ \exp(-ik \cdot \theta(t) - i\theta_{m,k})\end{matrix}}{2i} \\
&= a_{m,k}(t) \cdot \frac{\begin{matrix}\exp(ik \cdot \theta(t)) \cdot (\alpha_{m,k} + i\beta_{m,k}) - \\ \exp(-ik \cdot \theta(t)) \cdot (\alpha_{m,k} - i\beta_{m,k})\end{matrix}}{2i} \\
&= a_{m,k}(t) \cdot \begin{pmatrix} \alpha_{m,k} \dfrac{\exp(ik \cdot \theta(t)) - \exp(-ik \cdot \theta(t))}{2i} + \\ \beta_{m,k} \dfrac{\exp(ik \cdot \theta(t)) + \exp(-ik \cdot \theta(t))}{2} \end{pmatrix} \\
&= a_{m,k}(t) \cdot (\alpha_{m,k} \sin(k \cdot \theta(t)) + \beta_{m,k} \cos(k \cdot \theta(t))) \\
&= A_{m,k}(t) \cdot \sin(k \cdot \theta(t)) + B_{m,k}(t) \cdot \cos(k \cdot \theta(t))
\end{aligned}$$

in which $A_{m,k}(t) = a_{m,k}(t) \cdot \cos(\theta_{m,k})$ and $B_{m,k}(t) = a_{m,k}(t) \cdot \sin(\theta_{m,k})$.

One purpose of the initialization 54 is to provide an estimate of the instantaneous phase for each mud pump in the pump system. The noise attenuation process is based on automatic detection of spectral peaks with a selected harmonic relationship. The goal is to generate a set of pump output signals that have the highest probabilities to be valid fundamental frequencies of the pump noise. Based on this spectral detection, the method includes selecting a set of P frequencies that are most likely to be the fundamental frequencies of the pressure variations generated by the pump system (36 in FIG. 1).

With a set of P harmonics for M pumps, the number of unique combinations of fundamental frequencies and associated harmonics $C_p^M$ is determinable by the binomial formula:

$$C_P^M = \frac{P!}{M! \cdot (P-M)!}$$

In order to analyze the entire set of selected frequencies, a number $C_M^P$ of filters, for example, Kalman filters, are initialized at 54. Because of the large number of permutations in the set P of harmonics, it is preferable that the calculations are performed in parallel.

The outputs of the $C_p^M$ Kalman filters are sent to the best hypothesis selector 64. The best hypothesis selector 64 determines which of the Kalman filters performs the best. One criterion that can be used to determine best performance is the ratio between the energy in the estimated noise signal and the energy in the denoised signal. Once the remaining $C_p^M$–1 filters have been identified, the index of each such remaining filter is conducted to the initialization 54 whereupon the filters will be reinitialized in the next operation of the denoising procedure. As previously explained, the best noise estimate is transmitted to the summing device 66 and is combined with the transducer signal.

In another aspect, the invention relates to computer programs stored in computer readable media. Referring to FIG. 7, the foregoing process as explained with reference to FIGS. 1-6, can be embodied in computer-readable code. The code can be stored on a computer readable medium, such as floppy disk 164, CD-ROM 162 or a magnetic (or other type) hard drive 166 forming part of a general purpose programmable computer. The computer, as known in the art, includes a central processing unit 150, a user input device such as a keyboard 154 and a user display 152 such as a flat panel LCD display or cathode ray tube display. According to this aspect of the invention, the computer readable medium includes logic operable to cause the computer to execute acts as set forth above and explained with respect to the previous figures.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for attenuating pump noise in a wellbore drilling system, comprising: spectrally analyzing measurements of a parameter over a selected time frame, said measurements related to operation of a pump system used to move drilling fluid through the wellbore drilling system; wherein the spectral analysis results in an output; generating synthetic spectra of the parameter based on a number of pumps in the pump system and a selected number of harmonic frequencies for each pump; determining, using a processor, which of the synthetic spectra most closely matches the output; and using the most closely matching synthetic spectrum to reduce noise in a detected signal transmitted from a part of the drilling system disposed in a wellbore.

2. The method of claim 1 wherein the synthetic spectra include at least one fundamental frequency based on a signal from a pump stroke counter.

3. The method of claim 1 wherein the determining the most closely matching spectrum comprises applying a Bayesian filter.

4. The method of claim 3 further comprising generating a set of Kalman filters.

5. The method of claim 1 wherein the determining the most closely matching spectrum comprises determining a minimum energy in a difference between the measured parameter and the synthetic spectra.

6. The method of claim 1 wherein the parameter comprises pump pressure.

7. The method of claim 1 wherein the parameter comprises at least one of pump current, pump voltage and Hall effect detected proximate the pump.

8. The method of claim 1 wherein the detected signal corresponds to measurements made by at least one sensor disposed in the part of the drilling system disposed in the wellbore.

9. The method of claim 1 wherein using the most closely matching synthetic spectrum to reduce noise in the detected signal further comprises subtracting the most closely matching synthetic spectrum from the detected signal.

10. The method of claim 5, further comprising iterating the steps of claim 1 until the difference between the most closely matching synthetic spectrum and the detected signal falls below a predetermined threshold.

11. The method of claim 1, further comprising iterating the steps of claim 1 until the noise in the detected signal falls below a predetermined threshold.

12. A computer program stored in a non-transitory computer readable medium, the program including logic operable to cause a programmable computer to perform steps comprising:

spectrally analyzing measurements of a parameter over a selected time frame, said measurements related to operation of a pump system used to move drilling fluid through a wellbore drilling system;

generating synthetic spectra of the parameter based on a number of pumps in the pump system and a selected number of harmonic frequencies for each pump;

determining which of the synthetic spectra most closely matches the spectrally analyzed parameter output; and using the most closely matching synthetic spectrum to reduce noise in a detected signal transmitted from a part of the wellbore drilling system.

13. The computer program of claim 12 wherein the synthetic spectra include at least one fundamental frequency based on a signal from a pump stroke counter.

14. The computer program of claim 12 wherein the determining the most closely matching spectrum comprises Bayesian filtering.

15. The computer program of claim 14 wherein the Bayesian filtering comprises generating a set of Kalman filters.

16. The computer program of claim 12 wherein the determining the most closely matching spectrum comprises determining a minimum energy in a difference between the measured parameter and the synthetic spectra.

17. The computer program of claim 12 wherein the parameter comprises pump pressure.

18. The computer program of claim 12 wherein the parameter comprises at least one of pump current, pump voltage and Hall effect detected proximate the pump.

19. The computer program of claim 12 wherein using the most closely matching synthetic spectrum to reduce noise in the detected signal further comprises subtracting the most closely matching synthetic spectrum from the detected signal.

20. The computer program of claim 12 further comprising iterating the steps of claim 1 until the noise in the detected signal falls below a predetermined threshold.

* * * * *